United States Patent [19]

Schulte et al.

[11] 4,255,185

[45] Mar. 10, 1981

[54] PROCESSES AND APPARATUS FOR REDUCING AND SUBSEQUENTLY PELLETIZING MOIST FINE-GRAINED ORE

[75] Inventors: Hans-Gerd Schulte, Enniger; Heinz-Emil Merz, Diestedde, both of Fed. Rep. of Germany

[73] Assignee: Polysius AG, Beckum, Fed. Rep. of Germany

[21] Appl. No.: 969,463

[22] Filed: Dec. 14, 1978

[30] Foreign Application Priority Data

Jan. 4, 1977 [DE] Fed. Rep. of Germany ..... 2800211

[51] Int. Cl.[3] ..... C21B 13/00

[52] U.S. Cl. ..... 75/36; 75/3; 266/144; 266/157; 266/173

[58] Field of Search ..... 75/1, 3, 4, 5, 33, 34, 75/35, 36, 37, 38, 39, 44 R; 266/144, 156, 157, 173, 213, 249

[56] References Cited

U.S. PATENT DOCUMENTS

| | | | |
|---|---|---|---|
| 2,855,290 | 10/1958 | Freeman | 75/3 |
| 3,034,884 | 5/1962 | Mayer et al. | 75/36 |
| 3,386,816 | 6/1968 | English | 75/34 |
| 3,403,018 | 9/1968 | Thom | 75/25 |
| 3,945,817 | 3/1976 | Yatsunami et al. | 266/178 |
| 4,033,559 | 7/1977 | Pietsch | 75/0.5 BA |

FOREIGN PATENT DOCUMENTS

| | | | |
|---|---|---|---|
| 2601196 | 7/1977 | Fed. Rep. of Germany | 75/35 |

*Primary Examiner*—L. Dewayne Rutledge
*Assistant Examiner*—Michael L. Lewis
*Attorney, Agent, or Firm*—Learman & McCulloch

[57] ABSTRACT

Processes and apparatus for reducing and pelletizing moist fine-grained ore having zinc—and/or lead-containing impurities and wherein preheated ore is discharged to a rotary furnace in which the zinc and/or lead is separated from the ore and discharged from the furnace with its exhaust gases. The zinc and/or lead is separated from the exhaust gases and the thus purified gases dry the ore prior to the preheating thereof.

29 Claims, 2 Drawing Figures

PROCESSES AND APPARATUS FOR REDUCING AND SUBSEQUENTLY PELLETIZING MOIST FINE-GRAINED ORE

BACKGROUND OF THE INVENTION

Moist fine-grained ores continuously accumulate in relatively large quantities in LD-converters and blast furnaces, being recovered predominantly in sludge form by means of dust extractors. Hitherto, these moist fine-grained ores have generally been dumped together with dust-form ores accumulating in dry form. However, dumps such as these are no longer allowed for reasons of pollution control, with the result that the iron and steel industry has been forced to find ways of suitably processing the fine-grained ores in question. Table 1 below shows some examples of the chemical composition of fine-grained ores of the type in question which accumulate in dust form in blast furnaces and converters.

TABLE 1

| Constituents | Examples of blast furnace dust | | | Examples of LD-converter dust | | |
|---|---|---|---|---|---|---|
| (in % by weight) | A | B | C | D | E | F |
| P | 0.10 | 0.28 | 0.08 | 0.08 | 0.08 | 0.103 |
| S | 1.95 | 1.89 | 0.81 | 0.23 | 0.1 | 0.065 |
| $Na_2O$ | 0.12 | 0.13 | 0.11 | 0.25 | 0.22 | 0.16 |
| $K_2O$ | 0.28 | 0.34 | 0.22 | 0.08 | 0.05 | 0.03 |
| Pb | 5.9 | 1.50 | n.d. | 0.73 | 0.44 | n.d. |
| Zn | 15.5 | 4.30 | 3.74 | 1.81 | 2.36 | 0.55 |
| $C_{total}$ | 21.9 | 31.8 | 43.2 | 2.10 | 1.7 | 1.41 |
| $Fe_{total}$ | 21.2 | 31.6 | 24.2 | 51.1 | 51.8 | 69.23 |
| Mn | 0.25 | 0.56 | — | 0.78 | 0.8 | |
| $SiO_2$ | 4.40 | 5.40 | 5.94 | 0.86 | 0.9 | 1.82 |
| $Al_2O_3$ | 2.49 | 1.40 | 2.84 | 0.13 | 0.16 | 0.39 |
| $TiO_2$ | 0.18 | 0.07 | | 0.03 | 0.04 | |
| MgO | 0.81 | 0.5 | | 0.21 | 0.23 | |
| Cl | 0.124 | 0.10 | | 0.107 | 0.085 | |
| CaO | 3.6 | 3.7 | | 14.4 | 13.5 | |

Various processes have already been developed with a view to processing and also utilising these fine-grained ores accumulating in dust or sludge form. In these processes, the moist fine-grained ores are first dried, the agglomerates formed during drying crushed, the crushed agglomerates pelletised in pelletising pans or drums, and then subjected to heat treatment in a revolving tubular furnace for the purpose of reduction. During reduction in the revolving tubular furnace, zinc-containing and/or lead containing impurities present are simultaneously converted into oxides, removed from the revolving tubular furnace together with the exhaust gases, and separately recovered. These zinc and lead oxides are often present in concentrations of from 18% to 45% of zinc (=22.4% to 56% of ZnO) and from about 6 to 16% of lead (=6.5% to 17.2% of PbO), so that both metals are worthwhile recovering.

One disadvantage attending these known processes lies in the fact that the fine-grained ore present in the form of a moist filter cake has to be prepared at considerable expense for subsequent green pelletising which, if it is to be favourably carried out, requires a relatively narrow particle band width (i.e., as uniform a particle size as possible). Another disadvantage lies in the fact that the green pellets are only of relatively low strength and are introduced directly, i.e., without preliminary drying and prehardening, into the revolving tubular furnace in which they are subjected to severe mechanical stressing and, for this reason, are destroyed again to a considerable extent. The resulting dust and the pellet fragments seriously impede further processing and have to be re-pelletised in sintering installations for further metallurgical processing.

Applicants themselves have already developed a process of the kind referred to above. In this case, the fine-grained ore is reduced and subsequently agglomerated using a revolving tubular furnace for the final reduction step and a suspension preheater heated with the exhaust gases of this revolving tubular furnace for the preliminary reduction step and with introduction of a solid or liquid reducing agent into the gas pipe leading from the revolving tubular furnace to the preheater, the ore reduced to completion subsequently being agglomerated in the presence of a binder in a separate stage.

In such process the revolving tubular furnace is used only for the final reduction of the ore pre-reduced in the suspension preheater, agglomeration being carried out in a separate stage outside the revolving tubular furnace. In this way, the revolving tubular furnace can be specifically designed for reduction of the ore and can be made correspondingly shorter, because in contrast to other known processes, the revolving tubular furnace has no agglomeration zone. Since final reduction and agglomeration of the ore are carried out in two separate stages or units, it is possible in this way to obtain optimal reduction and agglomeration results. However, these good results are only obtained with dry, fine-grained ore, whereas the processing of moist, fine-grained ore, of the type accumulating in dust form for example in LD-converters and blast furnaces, is not possible.

Accordingly, the object of the present invention is further to develop a process of the type mentioned above (and the apparatus in which it is carried out) in such a way that, without losing any of its advantages, moist fine-grained ore, of the type accumulating in dust form in LD-converters and blast furnaces, can also be reduced and agglomerated in a fairly economical manner.

SUMMARY OF THE INVENTION

According to the invention, this object is achieved in that the zinc-containing and/or lead-containing impurities are separated from the exhaust gases of the revolving tubular furnace and the gases thus purified are used for drying the ore.

In the process according to the invention, the fine-grained ore is also preheated, pre-reduced, fully reduced and agglomerated in optimal manner by means of a suspension preheater, a revolving tubular furnace for the final reduction step, and a separate stage for agglomerating the fully reduced ore. According to the invention this optimal result is obtained by virtue of the fact that, before it is heat-treated in the suspension preheater, the moist fine-grained ore coming from the LD-converter or blast furnace is initially dried to the extent required for subsequent treatment in the suspension preheater, in the revolving tubular furnace used for final reduction, and in the agglomeration stage. This drying operation, which takes place at the beginning of the entire treatment cycle, is carried out extremely economically with the exhaust gases of the revolving tubular furnace used for the final reduction step. However, before the exhaust gases of this revolving tubular furnace are used for drying, the zinc-containing and lead-containing impurities converted into vapour form in this revolving tubular furnace are with advantage initially separated from these exhaust gases of the revolving tubular furnace together with the dusts present so that these dusts, which contain zinc oxide and lead oxide in relatively high concentrations, can be treated to recover these two metals.

Any filter suitable for fine separation may be used for separating the zinc-containing and/or lead-containing impurities. In general, an electrical precipitator is used for this purpose.

Since, in many cases, shapeless agglomerates are formed during drying of the moist or even sludge-like LD-converter and blast furnace dusts (partly in the form of filter cakes), it is of advantage according to the present invention to crush the ores during or immediately after drying to a fineness of less than 500 μm and preferably to a fineness of less than 300 μm.

In a first embodiment of the process according to the invention, the ore reduced to completion in the revolving tubular furnace is pelletized in a second revolving tubular furnace which forms the agglomeration stage and which is driven at a higher speed than the first revolving tubular furnace (used for the final reduction step), its exhaust gases being delivered to the suspension preheater. In this way it is possible, on the one hand, favorably to pelletise the fully reduced ore and, on the other hand, to use the exhaust gases from this second revolving tubular furnace for economically preheating and pre-reducing the dried fine-grained ore in the suspension preheater, in which case the necessary reducing agents may be introduced in solid or liquid form into the exhaust pipe of this second revolving tubular furnace in order to ensure the required prereduction effect.

In this embodiment of the process, it is also preferred to pass the ores through the first revolving tubular furnace in countercurrent to the furnace gases and through the second revolving tubular furnace in parallel current with the furnace gases.

Particularly favorable reduction and pelletising results can be obtained when the second revolving tubular furnace is driven at a rotational speed of from about 3 to 15 rpm and preferably at a rotational speed of from 6 to 8 rpm; whilst the first revolving tubular furnace is driven at a rotational speed of from about 0.4 to 1.8 rpm and preferably at a rotational speed of from about 0.4 to 1.0 rpm. Operation of the first revolving tubular furnace with a filling level of from about 10% to 25% and preferably from 15% to 25% contributes towards particularly economic working.

In a second embodiment of the process according to the invention, the ore reduced to completion in the revolving tubular furnace is briquetted in a hot briquetting unit forming the agglomeration stage. By agglomerating the fully reduced ore coming from the revolving tubular furnace in this way, the degree of reduction obtained in the revolving tubular furnace is always maintained to a particularly high degree. The briquettes thus produced may be directly cooled without any need for an additional cooling unit and, in addition, are particularly stable in storage, i.e., they are in virtually no danger of reoxidising.

In order not to impair the extremely favorable separation of zinc-containing and/or lead-containing impurities or the favorable drying of the moist ore, it is also of advantage in accordance with the invention to introduce hot gases from a separate combustion chamber into the suspension preheater. In this case, the solid or liquid reducing agent may be introduced into the pipe connecting the combustion chamber to the suspension preheater.

Apparatus for carrying out the process according to the invention may comprise a multi-stage suspension preheater connected to a gas pipe for preliminary reduction of the ore, a revolving tubular furnace for final reduction of the ore, and a separate unit following this revolving tubular furnace for agglomerating the ore reduced to completion. In such apparatus the suspension preheater is preceded by a drying unit which communicates with the revolving tubular furnace through its exhaust pipe, and a fine filter unit is arranged between the revolving tubular furnace and the drying unit for separating zinc-containing and lead-containing impurities.

According to the invention, this apparatus may be constructed either in such a way that the unit in which the fully reduced ore is agglomerated is formed by a second revolving tubular furnace which communicates with the suspension preheater through its exhaust pipe, this exhaust pipe having an inlet for air and reducing agent, or in such a way that the unit in which the fully reduced ore is agglomerated is formed by a hot briquetting unit following the revolving tubular furnace used for final reduction of the ore, in which case a separate combustion chamber is best associated with the suspension preheater for gas generation and the gas connecting pipe between the combustion chamber and the preheater has an inlet for air and reducing agent.

DESCRIPTION OF THE PREFERRED EMBODIMENTS

Figure 1:
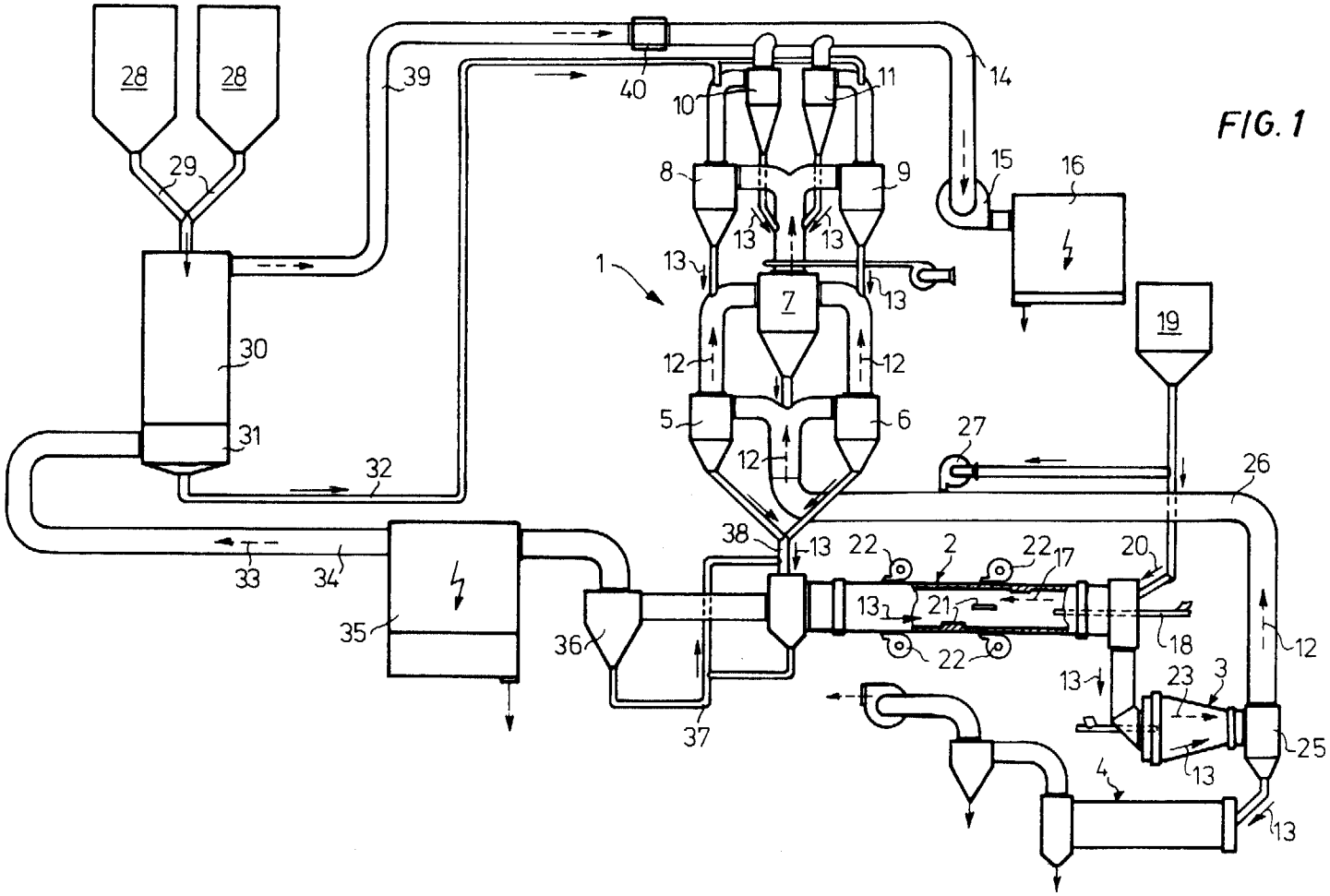
Figure 2:
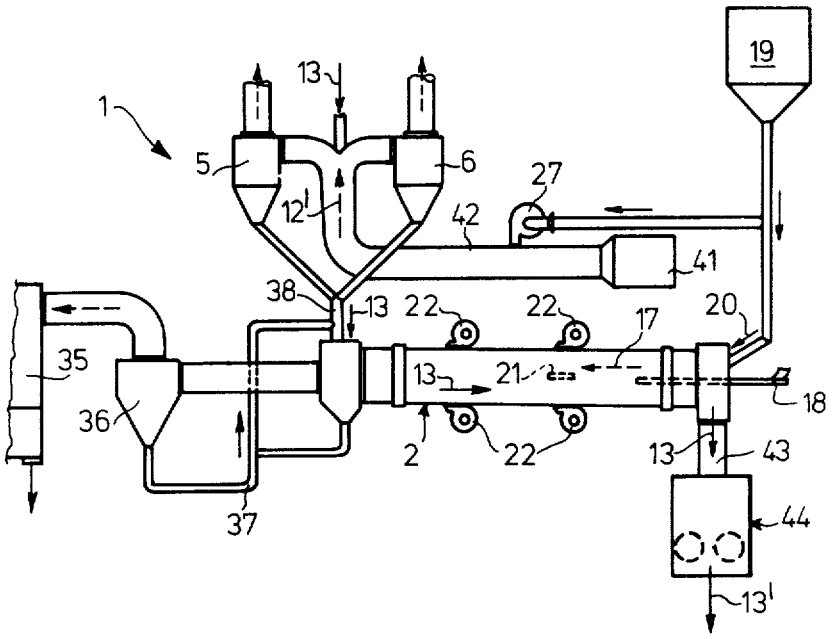

Further details of the invention will become apparent from the following description of two installations suitable for carrying out the process according to the invention in conjunction with the accompanying drawings, wherein:

FIG. 1 diagrammatically illustrates an entire installation according to the invention and in which the agglomerating unit is in the form of a second, separate revolving tubular furnace the exhaust pipe of which is connected to the suspension preheater; and FIG. 2 diagrammatically illustrates part of a second embodiment of apparatus according to the invention in which the agglomerating unit is formed by a hot briquetting unit and a separate combustion chamber is associated with the suspension preheater.

The first embodiment of apparatus according to the invention is diagrammatically illustrated in FIG. 1 and comprises a four-stage cyclone preheater 1 as the suspension preheater; a first revolving tubular furnace 2 intended for final reduction; and a second, separately arranged and driven revolving tubular furnace 3 used for pelletising the fully reduced ore. The second revolving tubular furnace 3 is followed in the direction of movement of the material by a pellet cooler which is shown in the form of a rotary drum cooler 4 and which directly and/or indirectly cools the pelletized ore in known manner.

The cyclone preheater 1 comprises two cyclones 5, 6 arranged in parallel in its first (lowermost) stage, a fluidising duct 7 in its second stage, two cyclones 8, 9 arranged parallel to one another in its third stage and another two cyclones 10, 11 in its fourth (uppermost) stage. The individual stages of this preheater 1 are interconnected in the usual way by material and gas pipes, the flow of the gases being indicated by chain-like arrows 12 and the flow of the material by solid-line arrows 13. A common exhaust pipe 14 leads from the fourth, uppermost cyclone stage (10, 11) via a ventilator 15 to a suitable filter unit which, in this case, is formed by an electrical precipitator 16.

The first revolving tubular furnace 2 used for final reduction is operated in countercurrent; in other words the material (arrow 13) passes through the revolving tubular furnace 2 in countercurrent to the furnace gases 17. A burner 18 projects into the discharge end of the revolving tubular furnace 2 in the usual way. In addition, a solid reducing agent, for example in the form of finely ground carbon, is introduced into this end of the revolving tubular furnace from a supply vessel 19 (arrow 20).

The first revolving tubular furnace 2 is constructed in such a way that it has a diameter-to-length ratio of from about 1:15 to 1:20, and further comprises a refractory lining with reversing and stirring elements 21 and, preferably, a number of mantle air ventilators 22 distributed over its circumference and its length. This first revolving tubular furnace is driven at a rotational speed of from about 0.4 to 1.0 rpm (and preferably at a rotational speed of from about 0.5 to 0.7 rpm) by a conventional drive (not shown).

The second revolving tubular furnace 3, which is downstream from the first revolving tubular furnace and is used for pelletising the ore, is considerably shorter than the first revolving tubular furnace and has a diameter-to-length ratio of from about 1:3 to 1:8, and preferably from about 1:4 to 1:6. In general, this second revolving tubular furnace may be completely cylindrical in shape although it has proved to be best, in the interests of effective pelletising, to make this second revolving tubular furnace 3 conical in shape so that it decreases in diameter toward its outlet end. Compared with the first revolving tubular furnace, this second revolving tubular furnace 3 is driven at a higher rotational speed (in the usual way by a conventional drive not shown) of from about 3 to 15 rpm and preferably from 6 to 8 rpm. In addition, this second revolving tubular furnace 3 is operated on the parallel current principle, i.e. the ore (arrow 13) passes through the revolving tubular furnace 3 in parallel current with the furnace gases 23, a central burner 24 projecting into the inlet end of this second revolving tubular furnace 3. In a discharge housing 25 of this second revolving tubular furnace, the pelletised ore is discharged downward whilst a furnace exhaust pipe 26 connects this second revolving tubular furnace 3 via the discharge housing 25 to the suspension preheater 1. Before the preheater 1, this furnace exhaust pipe 26 comprises an inlet 27 for air and reducing agent. In principle, it is possible to use any liquid or solid reducing agent. In the embodiment illustrated, a solid reducing agent, for example in the form of finely powdered carbon, is introduced from the carbon container 19.

Storage vessels 28 (of suitable construction and size) are provided for the moist fine-grained ore to be reduced and pelletised, and communicate through their material discharge pipes 29 with the inlet end of a dryer 30. Any suitable dryer (for example a vertical dryer, drum dryer, etc.) may be used for drying the ore accumulating for example in the form of filter cakes. In the illustrated embodiment, the dryer is in the form of a vertical dryer 30 adjoined at its lower end by a suitable crushing unit 31 (for example crushing rolls). A material pipe 32 leads from this crushing unit 31 to the fourth or uppermost stage of the cyclone preheater 1.

Furnace exhaust gases 33 are delivered to the combination of the vertical dryer 30 and crushing unit 31 used in the illustrated embodiment from the first revolving tubular furnace 2 via an exhaust pipe 34.

A fine filter suitable for separating zinc-containing and lead-containing impurities is built into this furnace exhaust pipe 34 coming from the first revolving tubular furnace 2. In this case, the fine filter is formed by an electrical precipitator 35. A coarse separator is provided in the furnace exhaust pipe 34 between the electrical precipitator 45 and the first revolving tubular furnace 2. In this case, the coarse separator is in the form of a cyclone separator 36 of which the material discharge pipe 37 is preferably connected to the material line 38 connecting the preheater 1 to the first revolving tubular furnace 2.

From the upper end of the vertical dryer 30, a pipe 39 for dry exhaust gases leads via a ventilator 40 to the electrical precipitator 16 of the preheater 1.

The installation described above operates as follows:

The moist fine-grained ore to be treated, which is in the form of filter cakes consisting of LD-converter and blast furnace dusts and, optionally, added dry dusts, is delivered from the storage vessels 28 to the vertical dryer 30 in which it is dried with the purified exhaust gases (arrow 33) from the first revolving tubular furnace 2 to a residual moisture content suitable for treatment in the suspension preheater 1 (between about 5% and 20%) and, immediately afterwards, is crushed in the crushing unit 31 to a fineness of less than 500 μm and preferably to a fineness of less than 300 μm. The ore thus dried and crushed is delivered via the material line 32 to the fourth or uppermost cyclone stage (10, 11) of the cyclone preheater 1.

In the cyclone preheater 1, the fine-grained ore introduced (arrow 13) is optionally further dried to begin with and, above all, preheated and prereduced at a material temperature of from about 600° C. to 800° C., preheating being carried out with the exhaust gases (arrow 12) from the second revolving tubular furnace 3 to which the solid reducing agent (from the container 19) and, optionally, air (at the inlet 27) are added. The prereduced material passes from the preheater 1 through the material pipe 38 to the inlet end of the first revolving tubular furnace 2 in which it is subjected to a further reducing treatment for final reduction. The carbon present in the material introduced is used for reducing the iron oxides and, in addition, the zinc and/or lead compounds present as impurities. If this carbon is not sufficient, more fine-grained carbon (or even other gas-rich carbon) may be blown in from the outlet end of the furnace from the container 19. In addition, it is possible to blow combustion air into this first revolving tubular furnace 2 through the mantle air ventilators 22 in order to burn the reduction of the gases formed, such as CO for example, and to adjust a desired temperature profile in the revolving tubular furnace. During this reduction in the first revolving tubular furnace 2, lead and zinc are removed in vapour form from the furnace charge and oxidised by oxygen and carbon dioxide in the furnace atmosphere. In this first revolving tubular furnace, the iron oxides are reduced to such an extent that the zinc and lead are almost completely volatilized.

The zinc and lead oxides formed in the first revolving tubular furnace 2 are discharged into the furnace exhaust pipe 34 together with the dust-form exhaust gases from this revolving tubular furnace 2. These furnace exhaust gases are initially subjected to coarse separation in the cyclone separator 36, from which the coarse dust fractions which, in general, are reused are returned through the material pipes 37 and 38 to the revolving tubular furnace 2. The furnace exhaust gases thus prepurified then pass into the electrical precipitator 35 in which they are subjected to fine separation in order to separate with the dust above all zinc oxide and lead oxide which may then be separately recovered. The exhaust gases purified in this way (arrow 33) are then removed through the exhaust pipe 34 and used for drying the moist fine-grained ore in the vertical dryer 30 and, optionally, in the crushing unit 31 as well.

Thereafter, the ore reduced to completion in the first revolving tubular furnace 2 is delivered (arrow 13) to the following second revolving tubular furnace 3 (which forms the separate agglomeration stage) through which it passes in parallel current with the furnace gases (arrow 23), being pelletised in the process. The pelletised ore (arrow 13) which accumulates in the furnace discharge housing 25 of this second revolving tubular furnace is then cooled in the following pellet cooler 4. The pellets of ore thus produced are strong enough to be able readily to withstand further processing in a metallurgical process (in a blast furnace or electric steel-making plant).

In the second embodiment of apparatus according to the invention for reducing and subsequently pelletising moist fine-grained ore, as illustrated in FIG. 2, only part of the apparatus has been diagrammatically illustrated because the main difference between this second embodiment and the first embodiment lies solely in the nature of the agglomeration of the fully reduced ore and in the supply of gas to the suspension preheater. The structure of the rest of this second embodiment of the installation corresponds exactly to that of the first embodiment (shown in FIG. 1), in addition to which the reference numerals in FIG. 2, corresponding to those used in FIG. 1, denote identical parts of the installation so that there is no need for them to be described again.

In this second embodiment according to the invention, the revolving tubular furnace 2 which is intended for final reduction of the ore is followed by a hot briquetting unit 44 as a separate agglomerating unit. This hot briquetting unit 44 is connected to the revolving tubular furnace 2 by a connecting pipe 43.

Accordingly, since in this second embodiment (compared with the embodiment illustrated in FIG. 1) no furnace exhaust gas is available for preheating and prereducing the ore in the suspension preheater 1 (which in this case is represented solely by the cyclones 5, 6 of the lowermost cyclone stage), a separate combustion chamber 41 is associated with the suspension preheater 1 for gas generation. This combustion chamber 41 is connected by a gas connecting pipe 42 to the lowermost preheater cyclone stage (cyclones 5, 6). In this case, too, the gas connecting pipe 42, in exactly the same way as the furnace exhaust pipe 26 in FIG. 1, is provided with an inlet 27 for air and reducing agent. The reducing agent may be introduced from the container 19, for example again in the form of finely powdered carbon or the like.

The initially dried moist, fine-grained ore is preheated and pre-reduced in the suspension preheater 1 by means of the gases produced in the combustion chamber 41 (chain-line arrow 12') and then optimally reduced to completion in the revolving tubular furnace 2 in exactly the same way as in the embodiment illustrated in FIG. 1. From the revolving tubular furnace 2, the fully reduced ore (arrow 13) then passes through the connecting pipe 43 into the hot briquetting unit 44 in which it is pressed into briquettes (cf. arrow 13'). The rest of the treatment cycle (in particular the drying of the moist fine-grained ore introduced and the separation of zinc-containing and/or lead containing impurities from the exhaust gases of the revolving tubular furnace) takes place in exactly the same way as in the installation shown in FIG. 1.

In addition to the already mentioned advantages of this second embodiment, it is further pointed out that, with certain types of ore and for certain chemical compositions of the output of the revolving tubular furnace used for final reduction, undesirable partial reoxidation can occur. In cases such as these, the installation shown in FIG. 2 and the process which may be carried out therewith have proved to be of particular advantage because the high degree of reduction in the briquettes produced from the fully reduced ore can always be maintained.

Finally, a practical embodiment is described in the following. A mixture of moist blast furnace and converter dust in the form of filter cakes was available for reduction and subsequent pelletising. The ratio by weight of blast furnace dust to converter dust (based on dry substance) amounted to 40:60, the blast furnace dust having a moisture content of around 38% and the converter dust a moisture content of around 32%.

TABLE 2

| (% by weight of the main constituents) | |
|---|---|
| $Fe_{total}$ | 41.3 |
| Zn | 5.9 |
| Pb | 2.5 |
| $C_{total}$ | 8.4 |

The moist fine-grained ore with this composition was dried in a vertical dryer to a residual moisture content of 14.3% in the manner described above by means of exhaust gases from the first revolving tubular furnace which had a temperature of about 380° C. The ore thus dried was crushed to a fineness of less than 500 μm and had good flow properties. The dried ore was delivered in this form to a multistage cyclone preheater in which it was preheated and pre-reduced at a material temperature of up to 780° C. The exhaust gases of the second revolving tubular furnace (which is intended for pelletising) were used for heating the cyclone preheater, lignite having a particle size of from 0 to 3 mm being added to these exhaust gases. The lignite was blown into the furnace exhaust pipe leading from the second revolving tubular furnace to the preheater by means of air and partly burnt. On entering the cyclone preheater, these furnace exhaust gases were reducing in character so that, in conjunction with the carbon present in the furnace exhaust gas and the ore, the iron oxides were partially reduced (34% reduction).

After the cyclone preheater, 92.8% of the fine-grained ore was metallised during reduction in the first revolving tubular furnace. 99.1% of the zinc present in the ore and 93% of the lead present were volatilised. After the removal of dust from the furnace exhaust gases coming from this first revolving tubular furnace in an electrical precipitator, the precipitator dust had a zinc content of 44.7% and a lead content of 12.4%.

This first revolving tubular furnace used for reduction was heated on the one hand by a natural gas fired central burner from the outlet end of the furnace and, on the other hand, by combustion of the carbon monoxide formed during reduction by means of mantle air (delivered through mantle air ventilators). By reducing the mantle air ventilators over the entire length, it was possible to adjust an extremely uniform temperature profile in this first revolving tubular furnace. The maximum material temperature in this first revolving tubular furnace amounted to around 1030° C. This first revolving tubular furnace was operated in countercurrent.

We claim:

1. In a process for reducing moist fine-grained ore containing zinc and/or lead impurities and wherein said ore is delivered to and preheated in a preheater, following which preheated ore is delivered to a reduction furnace and reduced in the presence of heat, following which reduced ore is discharged from said furnace and agglomerated, the improvement comprising providing a drying stage for said ore upstream from said preheater; separating said zinc and/or lead from ore in said furnace and discharging said zinc and/or lead from said furnace with furnace exhaust gases; delivering said exhaust gases in a direct path from said furnace to a purifier external of said furnace; separating said zinc and/or lead from said exhaust gases to purify the latter; and delivering purified exhaust gases directly following purification thereof to said drying stage for effecting drying of said ore.

2. A process according to claim 1 including drying said ore to a residual moisture content of from about 5% to 20%.

3. A process according to claim 1 including separating the zinc and/or lead in vapour form from ore in said furnace.

4. A process according to claim 3 including oxidising said zinc and/or lead in said furnace.

5. A process according to claim 1 including separating said zinc and/or lead from said exhaust gases by means of an electrical precipitator.

6. A process according to claim 5 including subjecting said exhaust gases to an initial coarse separation between the furnace and the electrical precipitator.

7. A process according to claim 1 including crushing said ore during or immediately after drying to a fineness of less than 500 $\mu$m.

8. A process according to claim 1 including delivering reduced ore from said furnace to a second furnace and pelletising said ore in said reduced second furnace.

9. A process according to claim 8 including delivering exhaust gases from said second furnace to said preheater.

10. A process according to claim 8 including rotating both of said furnaces, said second furnace having the higher rotary speed.

11. A process according to claim 10 including rotating said second furnace at a speed of from about 3 to 15 revolutions per minute and rotating the first mentioned furnace at a speed of from about 0.4 to 1.8 revolutions per minute.

12. A process according to claim 8 including passing the ore through the first mentioned furnace in countercurrent to its furnace gases and through the second furnace in parallel current with its furnace gases.

13. A process according to claim 1 including maintaining said furnace at a filling level of from about 10% to 25%.

14. A process according to claim 1 including delivering reduced ore from said furnace to a briquetting unit and briquetting said ore.

15. A process according to claim 1 including producing heated gases in a combustion chamber and introducing said heated gases into said preheater.

16. In apparatus for reducing moist fine-grained ore containing zinc and/or lead impurities and including the preheater for said ore, a reduction furnace downstream from said preheater, means for delivering ore from said preheater to said furnace, means for heating ore in said furnace to a temperature to reduce said ore and separate therefrom the zinc and/or lead, agglomerating means downstream from said furnace, and means for delivering reduced ore from said furnace to said agglomerating means, the improvement comprising exhaust gas purifier means; conduit means connecting said purifier means and said furnace for delivering directly to said purifier means the gas and separated zinc and/or lead exhausted from said furnace; dryer means for said moist ore upstream from said preheater; means for delivering said ore from said dryer means to said preheater; and means for delivering purified exhaust gas from said purifier means directly to said dryer means.

17. Apparatus according to claim 16 wherein said purifier means comprises an electrical precipitator.

18. Apparatus according to claim 16 wherein said purifier means comprises a coarse filter unit and a fine filter unit, said coarse filter unit being upstream of said fine filter unit.

19. Apparatus according to claim 18 wherein said coarse filter unit comprises a cyclone.

20. Apparatus according to claim 1 including means for supplying heated gases to said preheater.

21. Apparatus according to claim 16 wherein said agglomerating means includes a second furnace downstream from the first-mentioned furnace.

22. Apparatus according to claim 21 including briquetting means, and means for delivering ore from said second furnace to said briquetting means.

23. Apparatus according to claim 21 including means for conducting exhaust gases from said second furnace to said preheater.

24. Apparatus according to claim 1 including ore crushing means interposed between said dryer and said preheater.

25. Apparatus according to claim 21 wherein each of said furnaces is a rotary tubular furnace, and wherein the first-mentioned furnace has a diameter-to-length ratio of from about 1:15 to 1:20 and said second furnace has a diameter-to-length ratio of from about 1:3 to 1:8.

26. Apparatus according to claim 1 including a number of mantle air ventilators distributed over said furnace.

27. Apparatus according to claim 16 wherein said agglomerating means includes a tubular, rotary, second furnace, inlet means at one end of said second furnace for receiving ore from the first mentioned furnace, and outlet means at the opposite end of said second furnace, said second furnace having a decreasing diameter in a direction from its inlet to its outlet.

28. Apparatus according to claim 1 including ore cooling means downstream from said agglomerating means and means for delivering ore from said agglomerating means to said cooling means.

29. Apparatus according to claim 16 including a fuel combustion unit and means for conducting exhaust gases from said combustion unit to said preheater.

* * * * *